US006123587A

United States Patent [19]

Beloritski et al.

[11] Patent Number: 6,123,587

[45] Date of Patent: Sep. 26, 2000

[54] ELECTRICAL RECEPTACLE

[75] Inventors: Victor Beloritski, North Andover; Satishchandra Shantilal Mistry, Billerica; Robert Saba, Walpole, all of Mass.; Philip Charles Vaccaro, Merrimack, N.H.

[73] Assignee: The Whitaker Corporation, Wilmington, Del.

[21] Appl. No.: 08/962,207

[22] Filed: Oct. 31, 1997

Related U.S. Application Data

[60] Provisional application No. 60/033,682, Dec. 19, 1996.

[51] Int. Cl.[7] ..... H01R 11/22; H01R 13/11

[52] U.S. Cl. ..... 439/857; 439/828

[58] Field of Search ..... 439/850, 828, 439/857, 578, 579, 580, 581, 582, 583, 584, 585, 856, 830

[56] References Cited

U.S. PATENT DOCUMENTS

| | | | |
|---|---|---|---|
| 3,141,924 | 7/1964 | Forney, Jr. | 174/75 |
| 3,383,457 | 5/1968 | Schumacher et al. | 174/68.5 |
| 3,514,737 | 5/1970 | Renshaw, Jr. | 339/17 |
| 3,915,535 | 10/1975 | O'Keefe et al. | 339/17 |
| 4,545,638 | 10/1985 | Neidich | 439/787 |
| 4,721,481 | 1/1988 | Grellman et al. | 439/581 |
| 4,975,065 | 12/1990 | Rosenberg et al. | 439/63 |
| 4,990,109 | 2/1991 | Romerein et al. | 439/801 |
| 5,024,610 | 6/1991 | French et al. | 438/857 |
| 5,402,315 | 3/1995 | Reichle | 361/784 |
| 5,404,117 | 4/1995 | Walz | 333/34 |
| 5,618,187 | 4/1997 | Goto | 439/79 |

FOREIGN PATENT DOCUMENTS

| | | |
|---|---|---|
| 2-139876 | 7/1991 | Japan . |
| 06251833 | 9/1994 | Japan . |

OTHER PUBLICATIONS

Drawing, 05–2.9 Stripline Stress Relief Contact, B4 Omni Spectra, Inc. 1991.

*Primary Examiner*—Renee Luebke
*Assistant Examiner*—Antoine Ngandjui

[57] ABSTRACT

An electrical contact (6) has a base (18) for surface mount engagement with a circuit board (4), first spring fingers (19) on a first edge of the base (18), and second spring fingers (21) on a second edge of the base (18), the first spring fingers (19) and the second spring fingers (21) projecting upwardly to define respective sides (24, 25) of an electrical receptacle (23), and each of the first spring fingers (19) being offset along the base (18) from each of the second spring fingers (21).

3 Claims, 3 Drawing Sheets

Fig. 4
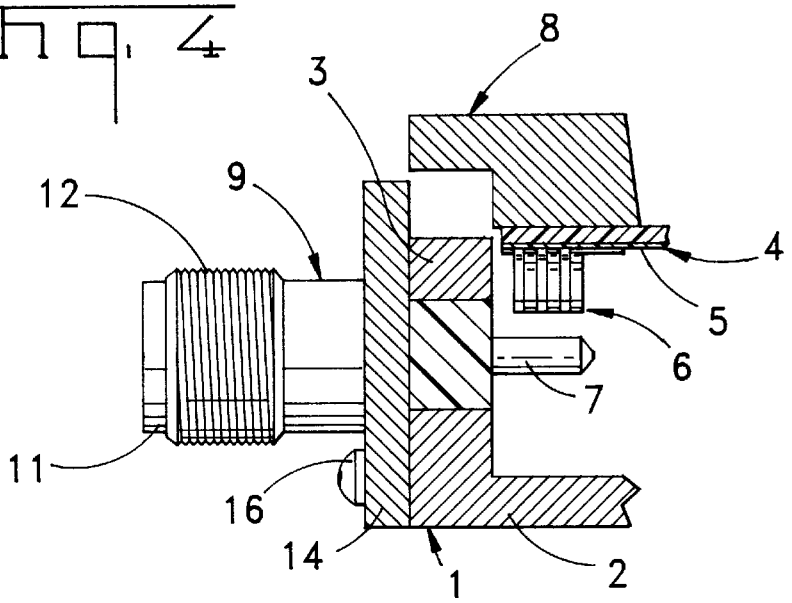
Fig. 5
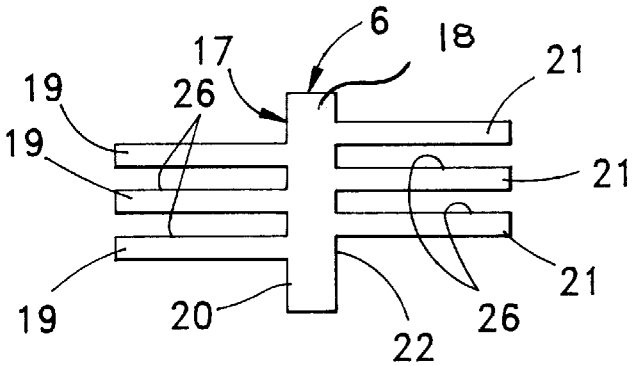
Fig. 6
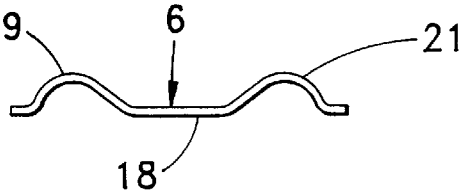
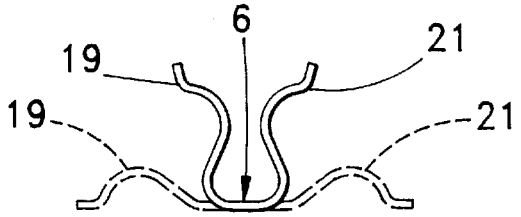
Fig. 7

ELECTRICAL RECEPTACLE

This application claims benefit of Provisional application Ser. No. 60/033,682, filed Dec. 19, 1996.

FIELD OF THE INVENTION

The present invention relates to an electrical contact, and more particularly, to an electrical contact for mating connection with a center contact of a coaxial connector.

BACKGROUND OF THE INVENTION

U.S. Pat. No. 3,514,737, discloses a known electrical receptacle for electrical mating connection with a central conductor of a circuit component. The receptacle will compensate for mating misalignment along a Z axis, the Z axis being coincident with the centerline of the central contact. The known electrical receptacle is deficient in the aspect of allowing for mating misalignment along an X axis and a Y axis, which are orthogonal to the Z axis.

SUMMARY OF THE INVENTION

The invention comprises, an electrical contact having an electrical receptacle that compensates for mating misalignment of a center contact of a coaxial connector with the electrical receptacle, along each of X, Y and Z, orthogonal axes.

An advantage of the invention resides in an electrical receptacle that compensates for mating misalignment along any of three orthogonal axes.

An advantage resides in an invention that will compensate for mating misalignment of a center contact of a coaxial connector with an electrical receptacle, which receptacle is suitable, for example, to launch an RF signal from a circuit path on a circuit board. According to an embodiment, the receptacle is suitable to launch an RF microwave signal from a microstrip.

Another advantage of the invention resides in first and second sets of spring fingers defining opposite sides of an electrical receptacle, wherein resiliency of the spring fingers is improved by the spring fingers crossing over one another to opposite sides of the electrical receptacle.

The invention further relates to an electrical contact for launching an RF microwave signal from a microstrip to a coaxial connector on an MIC package, meaning, a microwave integrated circuit package.

Preferred embodiments of the invention will now be described by way of example with reference to the accompanying drawings, according to which:

DESCRIPTION OF THE DRAWINGS

FIG. 4 is a view similar to FIG. 2 of another embodiment of an MIC package;

FIG. 5 is a development view of a metal blank prior to being formed to comprise the electrical contact, as shown in FIGS. 1–4;

FIG. 6 is an end view of the blank shown in FIG. 5;

FIG. 7 is view similar to FIG. 6, and illustrating a partly formed blank shown in FIG. 6;

DETAILED DESCRIPTION

Figure 1:
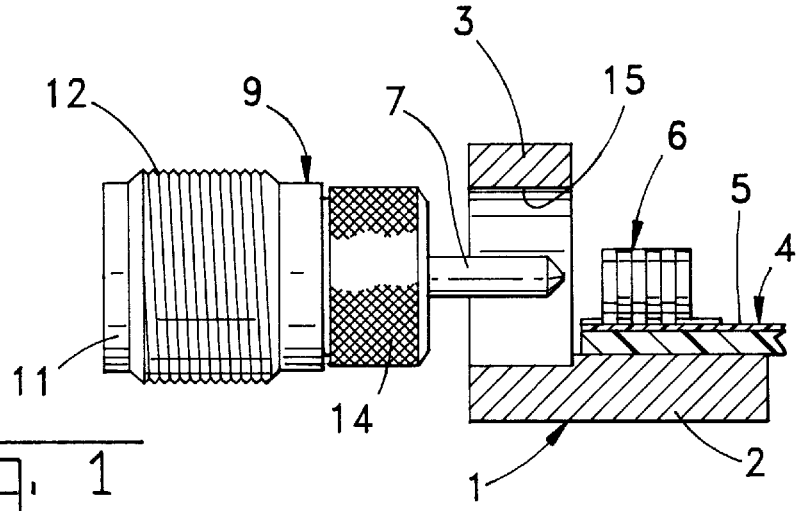
FIG. 1 is a section view of an MIC package, together with an electrical contact mounted on a circuit board, and further illustrating a coaxial connector.

With reference to FIGS. 1–4, embodiments of a conducting MIC package 1 will now be discussed. Each MIC package 1 comprises, a bottom wall 2 and an exterior wall 3. Further, a circuit board 4 is mounted inside the MIC package 1. According to the embodiments of FIGS. 1, 2 and 3, the circuit board 4 is supported by the bottom wall 2. According to the embodiment of FIG. 4, The circuit board 4 is supported by a conducting cover 8 that encloses the MIC package 1.

A conducting circuit path 5 on the circuit board 4 is electrically connected to a conducting electrical contact 6 on the circuit path 5. For example, the circuit path 5 comprises, a microwave signal path, or microstrip, and the electrical contact 6 comprises a launch for a microwave signal from the circuit path 5 to a center contact 7 of a coaxial connector 9 that is mounted on the exterior wall 3 of the MIC package 1.

With reference to FIGS. 1–4 the coaxial connector 9 is of known construction, for example, comprising, the center contact 7 supported by a concentrically encircling dielectric body 10, in turn, concentrically encircled by a conducting outer shell 11. At an open end of the coaxial connector 9, the outer shell 11 has a disconnect coupling portion 12. Further, at the open end of the coaxial connector 9, the center contact 7 has a disconnect coupling portion 13. A base portion 14 of the shell 11 aligns with an opening 15 through the exterior wall 3, followed by being secured to the exterior wall 3, establishing a ground or earth connection. According to FIGS. 1 and 2, the base portion 14 of the shell 11 is threaded or friction fit within the opening 15, and can be followed by solder joining to the exterior wall 3. According to FIGS. 3 and 4, the base portion 14 of the shell 11 is a transverse flange that secures to the exterior wall 3 with fasteners 16. The center contact 7 projects into the MIC package 1 for mating connection with the electrical contact 6. With each coaxial connector 9 of the embodiments of FIGS. 1 to 3, center contact 7 is inserted into an open end of contact 6 that is perpendicular to circuit board 4. With coaxial connector 9 of FIG. 4, center contact 7 is translated into and through the open top entrance of contact 6 (see FIG. 8). Thereby, the MIC package 1 is adapted with the coaxial connector 9. The electrical contact 6 launches an RF signal to the coaxial connector 9. The coaxial connector 9 establishes an external coupling for the rf signal and ground or earth.

With reference to FIGS. 5–7, further details of the electrical contact 6 will now be described. The electrical contact 6 is stamped and formed from a unitary metal blank 17, FIG. 5, and comprises a base 18 for surface mount engagement with the circuit board 4. The base 18 adapts the electrical contact 6 to be solder joined with the circuit path 5 on the circuit board 4. A series of first spring fingers 19 are on a first edge 20 of the base 18. A series of second spring fingers 21 are on a second edge 22 of the base 18.

Figure 8:
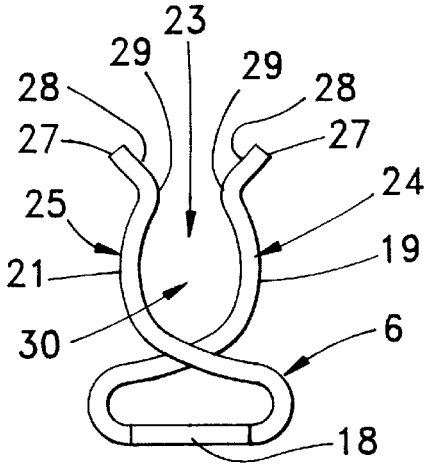
FIG. 8 is an end view of the electrical contact resulting from a fully formed blank, as shown partly formed in FIG. 7.

FIGS. 6–8 disclose progressively formed shapes of the spring fingers 19, 21. FIG. 8 further discloses, the first spring fingers 19 and the second spring fingers 21 projecting upwardly to define an electrical receptacle 23 for mating connection to the center contact 7 of the coaxial connector 9. The first spring fingers 19 define a first side 24 of the receptacle 23. The second spring fingers 21 define a second side 25 of the receptacle 23. Thereby, respective sides 24, 25 of an electrical receptacle 23 extend along the base 18. Further features of the embodiment will now be described.

Figure 10:
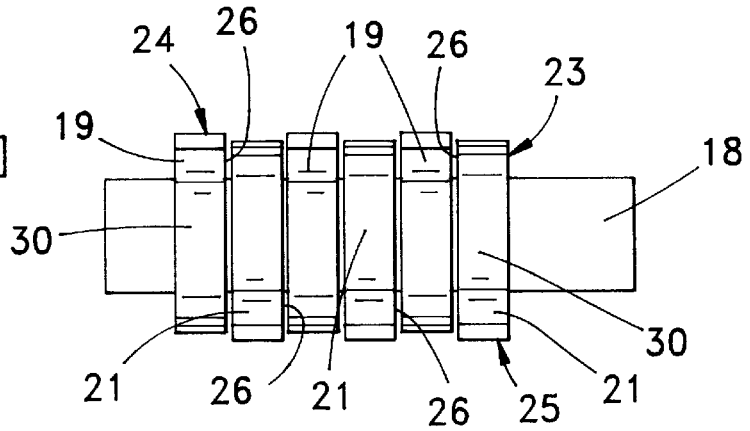
FIG. 10 is a top view of the electrical contact shown in FIGS. 8 and 9.
Figure 9:
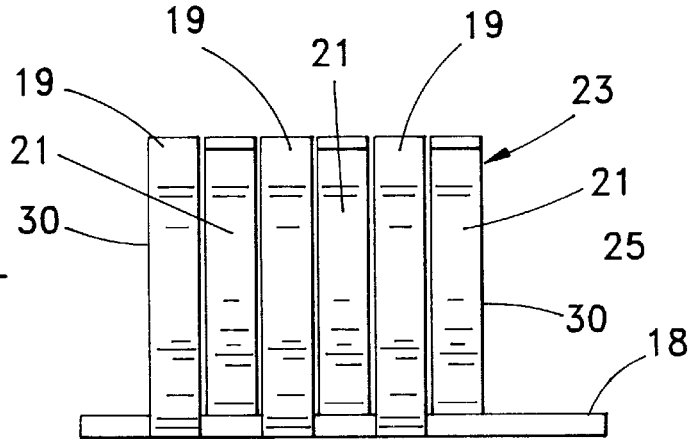
FIG. 9 is a side view of the electrical contact shown in FIG. 8.

With reference to FIGS. 9 and 10, each of the first spring fingers 19 are offset along the base 18 from each of the second spring fingers 21. The first spring fingers 19 on the side 24 of the electrical receptacle 23 oppose respective spaces 26 between the second spring fingers 21 on another side 25 of the electrical receptacle 23. Further, at least the first spring fingers 19 extend across the base 18 and project into the spaces 26 between the second spring fingers 21. The second spring fingers 21 project into additional respective spaces 26 between the first spring fingers 19.

Figure 2:
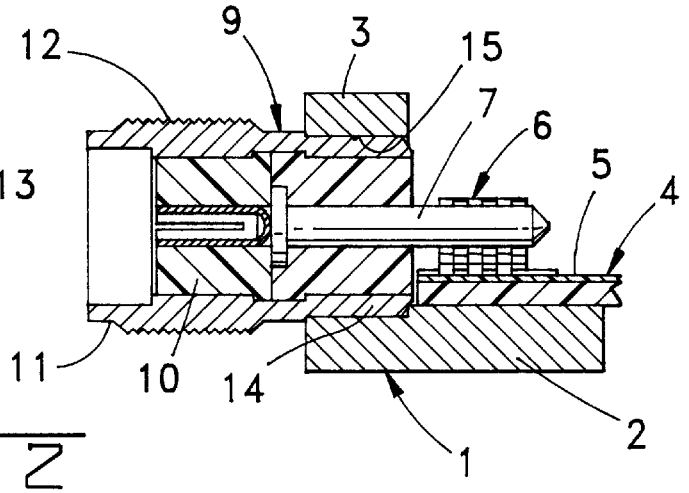
FIG. 2 is a view similar to FIG. 1, further illustrating the MIC package adapted with the coaxial connector in mating engagement with the electrical contact, as shown in FIG. 1.
Figure 3:
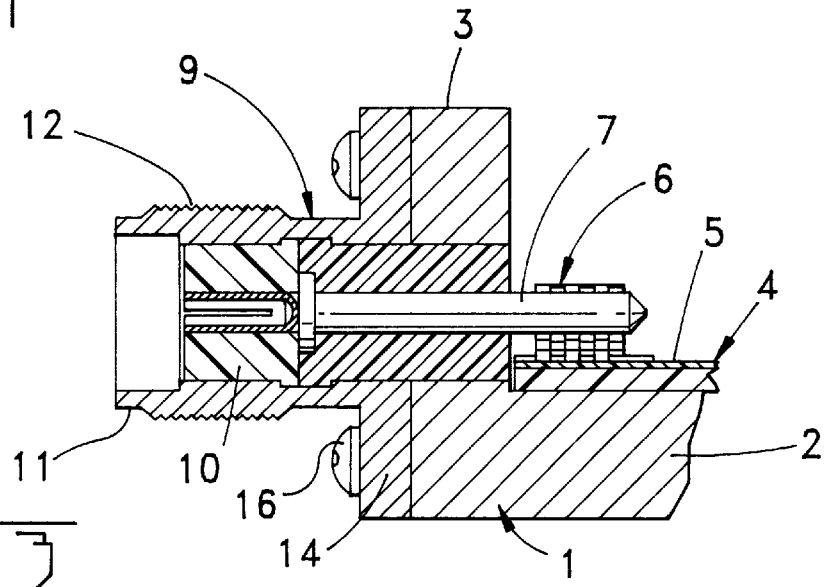
FIG. 3 is a view similar to FIG. 2 of another embodiment of a coaxial connector.

With reference to FIG. 8, the sides 24, 25 of the electrical receptacle 23 are outwardly bowed, by each of the spring fingers 19, 21 being outwardly bowed, to conform to the exterior of the center contact 7. Tips 27 of the spring fingers 19, 21 are bowed outwardly to define a flared first entrance 28 to a reduced throat 29 of the receptacle 23. This, first entrance 28, permits mating connection of the receptacle 23, as shown in FIG. 4, by movement of the receptacle 23 transversely with respect to the center contact 7. The receptacle 23 has open ends 30 at the outwardly bowed portion of the receptacle 23. At least one of the open ends 30 defines a second entrance of the receptacle 23. This, second entrance, permits mating connection of the receptacle 23, as shown in FIGS. 1–3, by movement of the receptacle 23 endwise and axially of the center contact 7. Mating connection is assured by the spring fingers 19, 21 frictionally engaging the center contact 7 with spring pressure.

The spring pressure results from resilient deflection of the spring fingers 19, 21 by engagement with the center contact 7. The spring fingers 19, 21 are lengthened to increase the amount of spring force, and to distribute internal stresses resulting from deflection. For example, as shown in FIG. 8, the first spring fingers 19 are lengthened, by extending across the base 18, and by extending beyond the second side 25 of the receptacle 23 to define the first side 24 of the receptacle 23.

The second side 25 of the receptacle 23 is defined by the second spring fingers 21. The second spring fingers 21 are lengthened, by extending across the base 18, and by extending beyond the first side 24 of the receptacle 23 to define the second side 25 of the receptacle 23. Accordingly, the first spring fingers 19 cross over the second side 25 of the receptacle 23 to define a first side 24 of the receptacle 23, and the second spring fingers 21 cross over the first side 24 of the receptacle 23 to define the second side 25 of the receptacle 23.

For example, each of the spring fingers 19, 21 has a length of about 0.125 inch, a width of about 0.025 inch, and a thickness of about 0.006 inch. The central axis of the open end 30 is about 0.056 inch from the bottom of the base 18. The inner diameter of 0.045 inch can expand to 0.050 inch to conform to the diameter of the center contact 7 of the coaxial connector 9. The first entrance 28 has a gap width of about 0.033 that flares to about 0.052 inch at the tips 27 of the spring fingers 19, 21. The gap width widens to allow passage of the center contact 7 into the receptacle 23, whereupon, the first entrance 28 will expand to about 0.050 inch and return to a gap width of about 0.034 to surround the center contact 7 with the receptacle 23. Forming the spring fingers 19, 21, as described above, will allow them to undergo elastic deflection to compensate for mating misalignment of the center contact 7, along the following axes; X axis 0.016 inch, Y axis 0.016 inch and Z axis 0.100 inch. The spring fingers 19, 21 undergo elastic deflection to avoid stress concentrations and consequent permanent distortion.

An advantage of the invention resides in an electrical receptacle 23 that compensates for mating misalignment along any of three orthogonal axes.

Another advantage of the invention resides in first and second sets of spring fingers 19, 21 defining opposite sides 24, 25 of an electrical receptacle 23, and resiliency of the spring fingers 19, 21 is improved by lengthening the spring fingers 19, 21 to cross over one another to opposite sides 24, 25 of the electrical receptacle 23.

What is claimed is:

1. An electrical contact comprising:

a base for surface mount engagement with a circuit board, first spring fingers on a first edge of the base, and second spring fingers on a second edge of the base, the first spring fingers and the second spring fingers projecting upwardly to define respective sides of an electrical receptacle; and said sides being outwardly bowed, and tips of the spring fingers being bowed outwardly to define a flared first conductor-receiving entrance at an open top of the receptacle and parallel to the base, and the receptacle having opposed open ends, at least one of the open ends defining a second entrance of the receptacle perpendicular to the base;

wherein each of the first spring fingers is offset along the base from each of the second spring fingers, wherein the first spring fingers on one side of said electrical receptacle oppose respective spaces between the second spring fingers on another side of the electrical receptacle, wherein the first spring fingers cross over the base and project into spaces between the second spring fingers adjacent to the base, and wherein the second spring fingers cross over the base and project into spaces between the first spring fingers adjacent to the base.

2. An electrical connection of a contact mounted onto a circuit board for mating with a mating contact, comprising:

a circuit board having a circuit path on a surface thereof, and a contact having a base connectable to said circuit path of said circuit board to establish an electrical connection therewith, said contact having first spring fingers extending from a first edge of said base upwardly therefrom to free ends, and said contact having second spring fingers extending upwardly from an opposed second edge of said base upwardly therefrom to free ends, the first and second spring fingers defining respective sides of an electrical receptacle extending along the base; and said sides being outwardly bowed, and tips of the spring fingers being bowed outwardly to define a flared first conductor-receiving entrance at an open top of the receptacle and parallel to the circuit board, and the receptacle having opposed open ends, at least one of the open ends defining a second entrance of the receptacle perpendicular to the circuit board wherein each of the first spring fingers is offset along the base from each of the second spring fingers, wherein the first spring fingers on one side of said electrical receptacle oppose respective spaces between the second springs fingers on another side of the electrical receptacle, wherein the first spring fingers cross over the base and project into spaces between the second spring fingers adjacent to the base, and wherein the second spring fingers cross over the base and project into spaces between the first spring fingers adjacent to the base.

3. An electrical connection as recited in claim 2 wherein said base is planar and surface mounted to the circuit board.

* * * * *